United States Patent [19]

Kambic

[11] Patent Number: 4,640,112

[45] Date of Patent: Feb. 3, 1987

[54] SECURITY DOOR KNOB AND ESCUTCHEON

[75] Inventor: Raymond V. Kambic, Joliet, Ill.

[73] Assignee: R. R. Brink Locking Systems, Inc., Plainfield, Ill.

[21] Appl. No.: 805,253

[22] Filed: Dec. 4, 1985

Related U.S. Application Data

[63] Continuation of Ser. No. 521,118, Aug. 8, 1983, abandoned.

[51] Int. Cl.[4] ..... A47B 35/04; E05B 9/08; E05B 15/02

[52] U.S. Cl. ..... 70/452; 70/370; 70/451; 292/357

[58] Field of Search ..... 70/451, 452, 370, 381, 70/356, 357, 372; 292/357

[56] References Cited

U.S. PATENT DOCUMENTS

| | | | |
|---|---|---|---|
| 435,250 | 8/1890 | Sampson | 292/357 |
| 563,867 | 7/1896 | Moser . | |
| 698,812 | 4/1902 | Carleton . | |
| 902,044 | 10/1908 | Augenbraun | 70/452 X |
| 1,128,392 | 2/1915 | Van Winkle . | |
| 1,195,713 | 8/1916 | Page . | |
| 1,611,838 | 12/1926 | Malicki . | |
| 2,578,608 | 12/1951 | Shull | 70/370 |
| 2,622,430 | 12/1952 | Adams et al. | 70/452 |
| 3,211,486 | 10/1965 | Crandell | 70/451 X |
| 3,212,308 | 10/1965 | Eads | 70/370 X |
| 3,343,386 | 9/1967 | Hall | 70/370 |
| 3,358,483 | 12/1967 | Wellekens | 70/370 |
| 3,390,908 | 7/1968 | Schlage . | |
| 3,455,129 | 7/1969 | Forbes et al. | 70/451 X |
| 3,503,233 | 3/1970 | Russell et al. | 70/370 |
| 3,745,795 | 7/1973 | Sanders | 70/370 |
| 3,810,145 | 5/1974 | Gusaras . | |
| 3,890,815 | 6/1975 | Raymond et al. | 70/363 |
| 3,899,907 | 8/1975 | Prahl | 70/370 |
| 4,067,599 | 1/1978 | Ohno | 292/357 X |
| 4,237,711 | 12/1980 | Kambic . | |
| 4,381,656 | 5/1983 | Hayakawa | 70/370 |
| 4,394,821 | 7/1983 | Best et al. | 70/381 |

FOREIGN PATENT DOCUMENTS

| | | |
|---|---|---|
| 480364 | 2/1938 | United Kingdom . |

*Primary Examiner*—Gary L. Smith
*Assistant Examiner*—Vinh Luong
*Attorney, Agent, or Firm*—Trexler, Bushnell & Wolters, Ltd.

[57] ABSTRACT

There is disclosed a secured door knob and escutcheon assembly, wherein the assembly is protected against tampering and unauthorized removal from either side of a door, when said door is in the closed position. The assembly includes a knob arrangement having mounting means which includes a bearing sleeve that is threadably engaged with a mounting plate affixed to the door. Rotation of said bearing sleeve is precluded by an apertured escutcheon plate through which said bearing sleeve is engaged. The bearing sleeve and escutcheon aperture have complementary flats or non-round surfaces such that when the escutcheon is in place rotation of the bearing sleeve is precluded. Further, the escutcheon plate is held in place by holding means that can only be released when the door is opened. In the disclosed embodiment the holding means is a key cylinder engaged through a second aperture in the escutcheon plate and fixed in place by a set screw mounted in the edge face of the door.

10 Claims, 4 Drawing Figures

10
12
14
16
18
20
22
24
28
30
32
36
38
39
40
41
42
44
45
46
47
50
52
54
56
58
60
62
64
68
69
72
74
76
84
90
92
94
96
98
100
102
104
112
114
122
132
134
136
152
154
156
176
178
8

SECURITY DOOR KNOB AND ESCUTCHEON

This application is a continuation of application Ser. No. 521,118, filed Aug. 8, 1983 now abandoned.

BACKGROUND OF THE INVENTION

The present invention is directed generally to the door lock and latch mechanism arts and more particularly to a novel security door knob and escutcheon assembly which prevents removal, vandalism or tampering with the lock from either side of a door, once the door is in the closed position.

Many door latch mechanisms are provided with various security features, so as to normally prevent disassembly and removal of the knobs or lock mechanisms from at least one side of the associated door. In this regard, it is generally known to provide an escutcheon plate or the like overlying the latch and lock mechanisms on at least one side of a door, which may be called the "secured" side.

The above-described conventional system may not, however, always prevent disassembly or removal of the associated door knob from the secured side of the door. To the contrary, the door knob and the associated latch-engaging shaft may be removed by use of special or improved tools. Hence, access to the latch mechanism may be accomplished even from the secured side of the door. Accordingly, considerable damage and/or vandalism may yet be accomplished, without actually achieving opening of the locked door, with the above prior art arrangement.

Moreover, neither the foregoing nor other conventional assemblies normally make any provision for preventing disassembly of the door knob and related components from the opposite or non-secured side of the door. In this regard, in many applications it may be desirable to secure both sides of the door. For example, in penal institutions or the like, the "inside" of the door and correspondingly the lock and latch will be accessible from the cell of the inmate, and hence an anti-tampering or security design is desirable. Also, it is desirable to prevent tampering with the latch, knobs and associated escutcheon or mounting plate assemblies from the other or "outside" of such a door.

OBJECTS AND SUMMARY OF THE INVENTION

Accordingly, it is a general object of the invention to provide a novel and improved security door knob and escutcheon assembly.

A more particular object is to provide such an assembly which is incapable of disassembly and/or removal from either side of a door, once assembled, and the door is in the closed position.

A related object is to provide a door knob and mounting assembly in accordance with the foregoing objects which is relatively simple and inexpensive in its design and manufacture and yet highly reliable in operation.

Briefly, and in accordance with the foregoing objects, a security door knob assembly comprises respective inner and outer door knobs and mounting means for mounting the inner door knob to the inner side of a door and the outer door knob to the outer side of the door, so as to operate an associated latch mechanism. Novel co-acting securing means are provided for preventing disassembly of said knobs or of said mounting means from the door from either of the inner or outer sides of the door, once assembled therewith.

DESCRIPTION OF THE DRAWINGS

The foregoing, as well as other objects, features and advantages of the invention will be more readily appreciated upon consideration of the following detailed description of the illustrated embodiment, together with the accompanying drawings wherein.

DETAILED DESCRIPTION OF THE ILLUSTRATED EMBODIMENT

Figure 1:
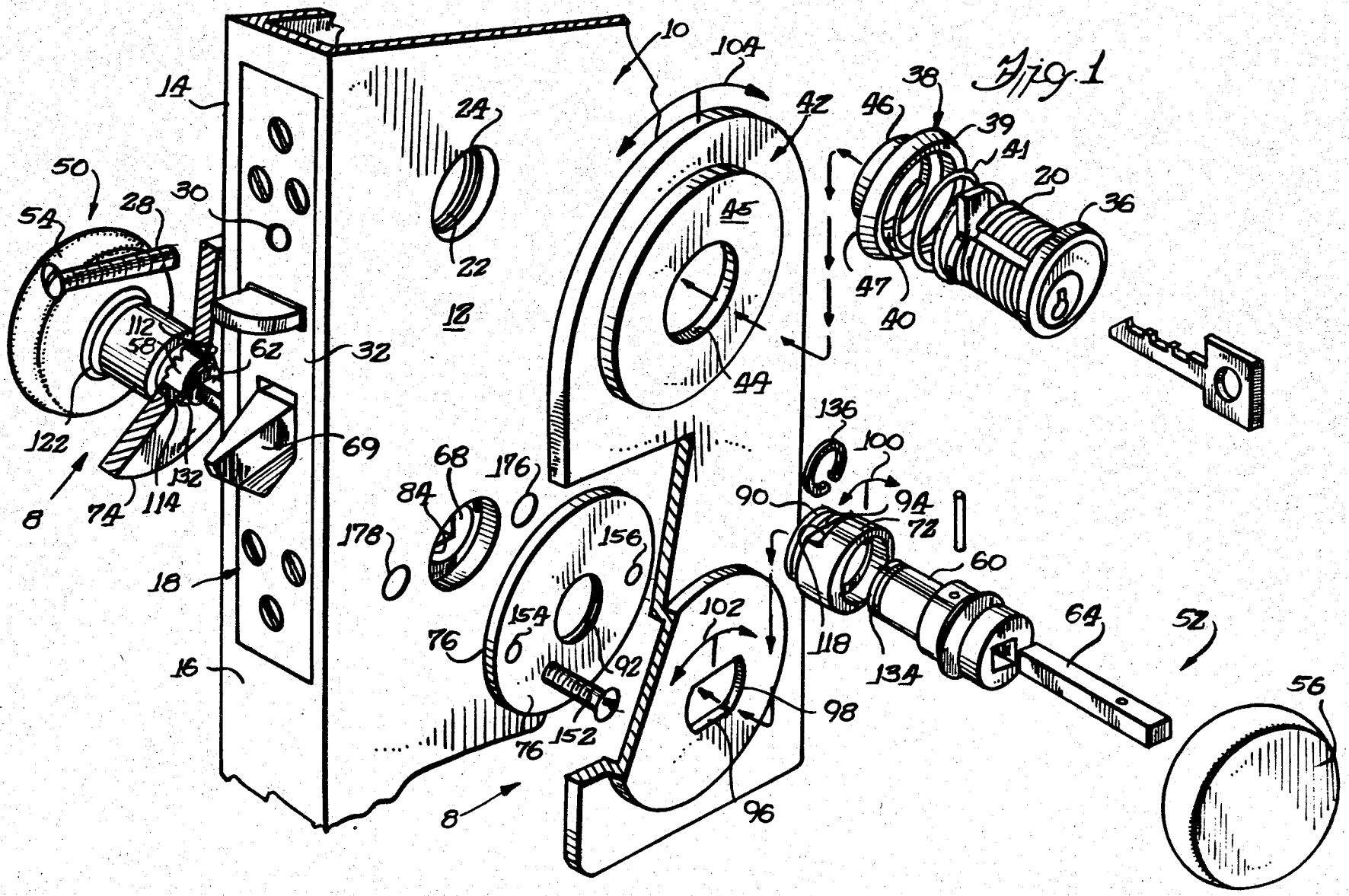
FIG. 1 is an exploded perspective view of a novel security door knob assembly in accordance with the invention and illustrating its assembly with a typical door.

Referring now to the drawings and initially to FIG. 1, a security door knob and escutcheon assembly in accordance with the invention is designated 8 and illustrated in conjunction with a cell door 10. In the view shown in FIG. 1, for purposes of discusson one side 12 of the cell door is designated as the outer side thereof and the opposite side 14 is designated as the inner or secured side thereof. These designations are with respect to a building or enclosure upon which the door is mounted.

As will be seen presently, both inner and outer sides 12, 14 of the door 10 are "secured" in accordance with the invention. That is, once assembled with the cell door 10, and with the cell door closed the knobs, escutcheon and associated mounting assembly are not removable from the door from either side 12 or 14 thereof. Rather, as will presently be described, opening of the door 10 for access to its edge portion 16 is required to effect disassembly of the escutcheon, knobs and mounting assembly.

In the latter regard, the lock and latch assembly indicated generally at 18 takes the form of a security lock mechanism of the type shown in my prior U.S. Pat. No. 4,237,711. However, other suitable lock and/or latch assemblies may be utilized without departing from the invention.

Figures 2, 3, 4:
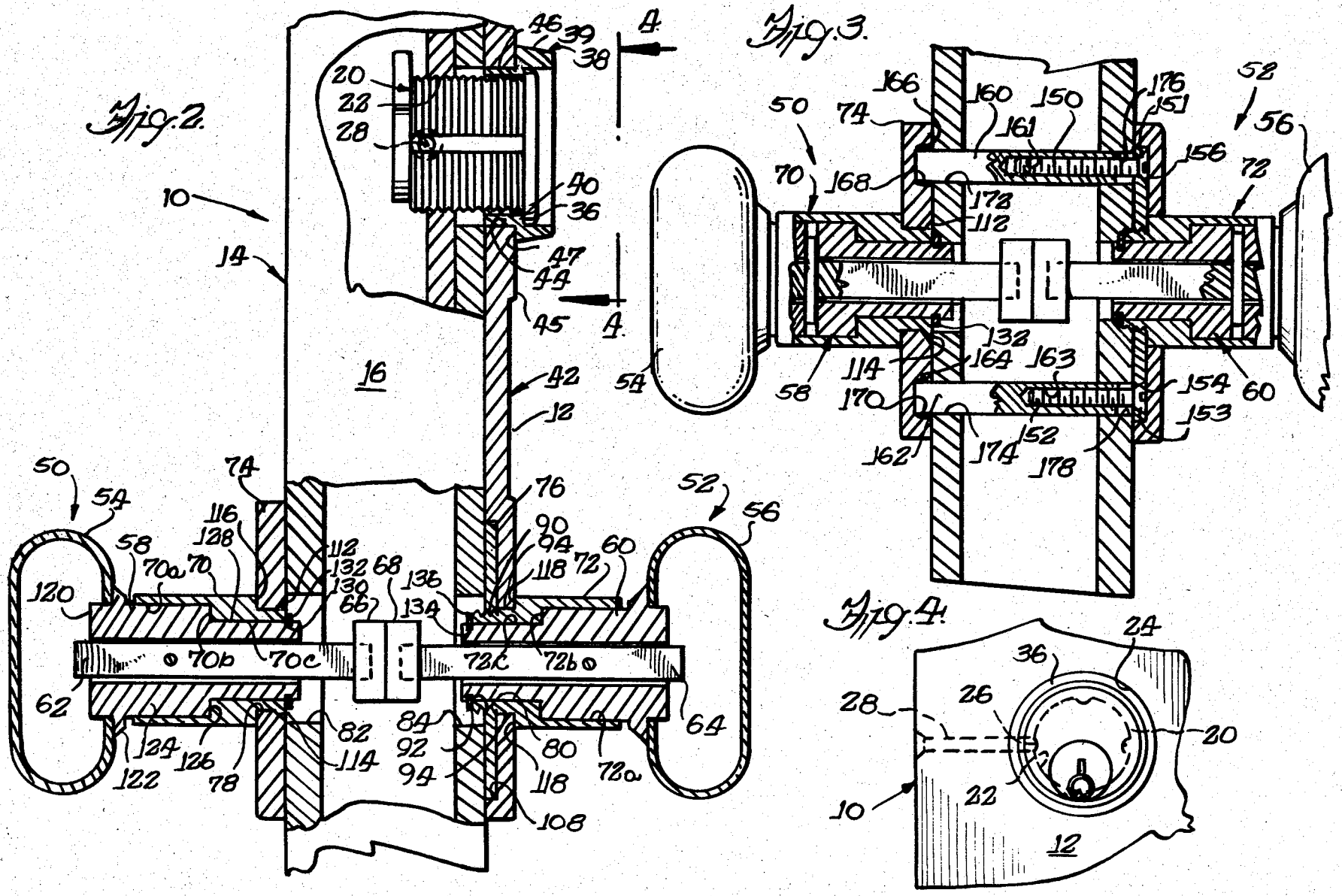
FIG. 2 is an elevation, partially broken away and partially in section, of the assembly of FIG. 1 in assembled condition with the door.
FIG. 3 is a top plan view, partially broken away and partially in section, of the assembly of FIG. 2.
FIG. 4 is a partial view taken generally along the line 4—4 of FIG. 2.

As also shown in FIGS. 2 and 4, a suitable cylinder-type lock 20 is threadably engageable with a complementary internally threaded opening 22 provided therefor in the lock assembly 18 interiorly of the door 10. To this end, a through aperture 24 is provided in the outer door surface 12 for receiving the lock 20 therethrough for engagement of said lock 20 in the complementary internally threaded opening 22. The lock cylinder 20 is provided with a longitudinal groove or slot 26 along one side thereof which upon assembly of cylinder 20 and lock mechanism 18, is aligned facing the edge portion 16 of the door.

Accordingly, a set screw 28 or similar means is engaged through an opening 30 provided therefor in the edge portion 16 of the door and more particularly through a mounting plate portion 32 of the lock or latch assembly 18. As best viewed in FIG. 4, this set screw 28 engages the groove or slot 26 of the cylinder lock 20 thereby preventing rotation thereof and maintaining the lock 20 in position. Hence, set screw 28 prevents removal of lock 20 from the complementary threaded aperture 22 provided in the lock mechanism 18 interiorly of the door 10. Clearly, release of set screw 28 from groove 26 will free the cylinder lock 20 for rotation and removal.

Preferably, the lock cylinder 20 also includes an outer shoulder portion 36. An additional cylinder ring 38 is provided for overlying this outer shoulder portion 36 of lock cylinder 30. In this regard, an inner diameter of the ring 38 is suitable for receiving the cylinder body therethrough while an outer recess portion forms a complementary interior shoulder 40 for seating the shoulder 36 therewithin. The ring 38 thereby surroundingly engages and protects the outer portion 36 of the lock cylinder 20 against possible tampering.

In accordance with one aspect of the invention, a novel escutcheon plate 42 is provided. This escutcheon plate overlies the aperture 24 in the door 10 and receives the lock ring 38 in a suitable through aperture 44 provided therein which is alignable with aperture 24. This aperture 44 is sized to receive an inner extension portion 46 of the ring 38, which together with an outer ring surface portion 39 forms an additional shoulder portion 47 for engagement against a flat outer surface 45 of escutcheon plate 42 about the through aperture 44 therein.

From the foregoing, it will be appreciated that assembly of the ring 38 and and cylinder 20 with escutcheon plate 42, the threaded engagement of said cylinder 20 with the thread aperture 22 of the lock mechanism 18, and the engagement of lock cylinder 20 by set screw 28, all cooperate effectively to hold and to lock the escutcheon plate 42 in place upon the outer surface 12 of the door 10. That is, the escutcheon plate 42 cannot thereafter be removed without first gaining access to the edge 16 of the door and removing or otherwise releasing set screw 28 from its engagement with lock 20, as previously described.

It should be noted that the cylinder ring 38 may be dispensed with, without departing from the invention. In this instance the shoulder portion 36 of the cylinder 20 would serve to overlie the area of escutcheon plate 42 about the through aperture 44. However, it is preferred to utilize the additional ring 38 so as to effectively prevent direct access to the cylinder 20, as for example, with various lock pulling tools or the like. In this regard, it will be noted that the outer surface 39 of the ring 38 is preferably inwardly beveled, so as to converge in a direction outwardly of the door surface 12, thereby discouraging gripping thereof by such lock pulling or other similar tools.

In accordance with the invention, therefore the escutcheon plate 42 is advantageously shaped and disposed so as to overlie further mounting means for the door knob assembly to be next described, such that the door knob and mounting assembly cannot be removed without first effecting the release of the escutcheon 42 as just described. Further details of the door knob and mounting assembly therefor will be described with reference to FIGS. 2 and 3.

Details of the cooperating knob assemblies, mounting assemblies and escutcheon plate 42 for achieving the non-removable mounting thereof to the door 10 will now be described in further detail with reference to FIGS. 2 and 3.

Respective inner and outer knob assemblies are designated generally by reference numerals 50 and 52. Each assembly 50, 52 includes a suitable knob member 54, 56 which is non-rotatably coupled, as by a weld or interference fit, to a corresponding knob extension member 58, 60. These knob extension members 58, 60 have non-round and preferably rectilinear through axial bores for receiving therethrough a complementary rectilinear shaft member 62, 64. These shaft members are generally of conventional form and cooperate with suitable cam means of the latching mechanism 18, here designated generally at reference numerals 66 and 68. The cam means 66 and 68 are operatively coupled to components of the latch mechanism 18, such that rotation of the knob members 54 or 56 will operate the latch bolt 69 to accomplish latching and unlatching of a door latch mechanism in conventional fashion. Other portions of this latch mechanism are not shown here as they are conventional and form no part of the present invention. In this regard, reference is invited to above-mentioned U.S. Pat. No. 4,237,711 for a showing of a suitable latch assembly. The latch mechanism 18 may be such as to be operable from either or both of the knob assemblies 50, 52.

Each of the knob extension members 58, 60 is rotatably received in a corresponding knob bearing or sleeve member 70, 72. With respect to the foregoing components, reference hereinafter to the various components in conjunction with the adjectives "inner" and "outer" will be understood to refer to the side of the door with which the member or assembly is associated.

The knob bearing or sleeve members 70 and 72 form mounting means for the knob assemblies in that each of the knob bearing or sleeve members 70, 72 is further received by a corresponding mounting plate member 74, 76, each of which is adapted to fit flush or substantially flat against one of the side surfaces 12, 14 of the door. These mounting plates 74, 76 have through central openings 78, 80 positionable generally coaxially with openings 82, 84 provided at either side of the door 10 to permit the shaft members 62, 64 to enter for engagement with suitable cams or other latch mechanisms 66, 68 as previously mentioned.

The outer knob bearing or sleeve member 72 and corresponding outer mounting plate 76 are provided with complementary engaging means, for interengagement therebetween. In the illustrated embodiment, these engaging means are provided in the form of an external thread 90 at an end portion of the bearing 72 and a complementary internal thread 92 formed in the through aperture 80 of the outer mounting plate 76.

In accordance with another important feature of the invention, the bearing sleeve 72 and estucheon plate 42 are provided with cooperating means for controlling rotation of the bearing sleeve 72 relative to mounting plate 76. In the illustrated embodiment, these cooperating means take the form of a pair of non-round or flat portions 94 on the exterior surface of the bearing or sleeve 72 and complementary surfaces including flats 96 defined in a through aperture 98 of the escutcheon plate 42. The flats 94 on the sleeve 72 also serve to define an abutment shoulder 118 which engage the plate 42 and prevent longitudinal movement thereof relative to sleeve 72. In operation, the interengagement of the respective flats prevents disengagement of bearing sleeve 72 from mounting plate 76 once assembled as illustrated in FIGS. 2 and 3. Referring to FIG. 1, the cooperation between these parts in effecting assembly and disassembly thereof with respect to the door 10 is illustrated by arrows 100, 102 and 104.

It will be appreciated that rotation, as indicated at 100, of the bearing or sleeve member 72 relative to mounting plate 76 is necessary to effect either assembly or disassembly of the lock or latch mechanism 18. Accordingly, the escutcheon plate 42 may be utilized as a "wrench" to effect rotation of bearing sleeves 72 in either direction due to engagement of the complementary and non-round aperture 98 with non-round surfaces 94 of the bearing sleeve 72. This latter rotation is indicated at 102 and 104. However, referring to the upper portion of escutcheon plate 42, it will be recognized that this rotation can only be accomplished upon removal of the lock cylinder 20 in the fashion previously described. Correspondingly, with the escutcheon plate 42 in place, rotation of the bearing sleeve 72, as would be required to disassemble the lock 18, is positively precluded.

Referring again to the lower portion of the escutcheon plate 42, it will be noted that the aperture 98 is formed in a recessed or offset portion 108 in the escutcheon plate 42. This recess 108 is complementary in configuration and located for receiving and overlying the outer mounting plate 76, thereby preventing access thereto from the outer side of the cell door 10. In this regard, it will be noted that both recess 108 and mounting plate 76 are circular. Moreover, the above-mentioned complementary shaped aperture 98 and surface 94 of bearing sleeve 72 are substantially coaxially aligned with mounting plate 76 and complementary recess 108. Hence, the foregoing structure permits rotation of the escutcheon plate as indicated by arrows 104 during removal or disengagement of the bearing sleeve 72 from mounting plate 76.

Referring now to the inner side 14 of the cell door 10, the bearing sleeve member 70 and inner mounting plate 74 will now be considered, which also are provided with complementary or cooperating coupling means. In this regard, the bearing sleeve 70 at its leading end portion is provided with a radially outwardly flared or upset portion 112. This flared portion 112 is configured for engagement with a generally complementary undercut or abutment portion 114 formed on an inner surface of mounting plate 74. Preferably, the plate 74 is first provided with undercut surface 114 whereupon the bearing sleeve 70 is assembled through the central through apertures 78 thereof, and thereafter the end of said sleeve is deformed outwardly by suitable means to form the complementary flare 112. In this regard, the bearing sleeve 70 is also provided with a step or radially outwardly extending shoulder portion 116 spaced apart from its leading end surface at flared out portion 112 by an amount substantially similar to the width or thickness of the mounting plate 74. Hence, upon the foregoing assembly operation, it will be noted that the mounting plate 74 is held between the flared out portion 112 and shoulder 116.

In the assembled condition of FIGS. 2 and 3 the respective mounting plates 74 and 76 are interconnected. The structure for effecting this interconnection and the manner in which the escutcheon 42 prevents disassembly will be discussed hereinfter with respect to FIG. 3.

It will now be noted that outer bearing sleeve member 72 carries a similar shoulder or step portion 118 set back a distance from the leading edge thereof for engagement with the outer surface of escutcheon plate 42. This latter shoulder 118 serves to define the fully engaged extent of the threads 90 thereof with respect to threads 92 of the mounting plate and hence the limit of rotation thereof in one direction by escutcheon plate 42 as indicated by arrows 100, 102 and 104 in FIG. 1.

Referring briefly again to the respective knob extension members 58 and 60, it will be noted that these members are substantially identical, whereby only the member 58 will be fully described herein. In this regard, the member 58 includes a first or outermost end portion 120 which is here formed for receiving the substantially hollow knob member 54 thereabout in a press or interference fit. In this regard, an annular radially outwardly extending portion or surface 122 is provided somewhat inwardly of the end 120 to define a fully seated or assembled position of the knob member 54 with respect thereto. Thereafter, a first diameter portion 124 engages a corresponding first inner diameter portion **70*a* of the sleeve 70. This portion 124 extends to a radially inwardly extending shoulder portion 126 which thereafter defines a second smaller diameter portion 128. This shoulder 126 and smaller diameter portion 128 cooperate with a complementary internal shoulder portion 70*b* and smaller inner diameter portion 70*c* of sleeve 70, to define the assembled condition of extension 58, rotatably engaged within sleeve 70**.

In accordance with a preferred feature of the invention, means are also provided for holding the knob extension member 58 rotatably secured within the bearing or sleeve 70. To this end, a suitable annular groove 130 is provided about a leading end portion of the extension 58 and a snap ring 132 is engaged with this groove 130. From the foregoing, it will be seen that the knob extension member 58 is thereby non-removably and rotatably coupled with the bearing or sleeve 70. This results from engagement of the snap ring 132 with an end surface of flared out portion 112 of bearing or sleeve 70 and the corresponding engagement of complementary shoulders 126 and **70*b*. As mentioned, the structure and assembly of outer knob extension 60 with respect to outer bearing or sleeve 72 is substantially similar. Bearing or sleeve 72 includes a similar reduced diameter portion 72*a* and shoulder 72*b*. The knob extension 60 includes a similar annular groove portion 134 and a snap ring 136 is engaged therein to prevent removal of the knob extension 60 from sleeve 72**.

In accordance with a feature of the invention mentioned previously, means are provided for effectively coupling the outer mounting plate 76 with inner mounting plate 74 through the door 10. This arrangement holds both mounting plates 74, 76 in a substantially flat abutting on engaged condition against their respective corresponding door surfaces 12 and 14. In the illustrated embodiment, a suitable fastener assembly or arrangement is utilized for this purpose, which is accessible only from the outer side 12 of the cell door, and access to which is controlled or prevented by the escutcheon plate 42.

As best viewed in FIG. 3, a first part of this fastener assembly here takes the form of a pair of similar conventional externally threaded fastener members 150, 152 having conventional enlarged head portions 151, 153. In the illustrated embodiment, the outer mounting plate 76 is recessed or countersunk as indicated generally at 154, 156 to accommodate the threaded fasteners and particularly the heads thereof in a substantially flush condition with respect to the outer surface of said plate 76. This also facilitates the above-mentioned engagement of the recess 108 of escutcheon plate 42 over and about the mounting plate 76.

Cooperatively, the inner mounting plates 74 includes a pair of internally threaded post members 160, 162. In the illustrated embodiment, the post members 160 and 162 are essentially cylindrical members drilled and tapped from one end thereof as indicated generally at 161, 163 to threadably receive the externally threaded fastener members 150, 152. Additionally, the cylindrical post members 160 and 162 are affixed by suitable means to the inner mounting plate 74, preferably by weldments as indicated generally at 164, 166. To this end, in the illustrated embodiment suitable complementary recesses 168, 170 have also been provided in the inwardly facing surface of mounting plate 74 to receive the respective cylinders 160 and 162 in the foregoing fashion.

From the foregoing, it will be seen that assembly of the knob and mounting components with the door 10 in accordance with the non-removable security features of the invention is a relatively simple procedure. Initially, the internally threaded post members or cylinders 160 and 162 as well as inner bearing or sleeve member 70 are preferably pre-assembled with the inner mounting plate 74 in the fashion previously described. Pre-assembled knob 54 and knob extension 58 may then be further assembled with shaft 62 and rotatably coupled through the now pre-assembled bearing or sleeve 70 and mounting plate 74 by utilization of the snap ring 132 as previously described.

The foregoing parts thus assembled may now be further assembled with the inner surface 14 of the door 10, which is provided with suitably aligned through apertures 172 and 174 for receiving the cylindrical post members 160 and 162 therethrough. It will be noted that similar through apertures 176 and 178 are provided at outer surface 12 of the door 10 for similarly receiving the shanks of externally threaded fasteners 150 and 152 therethrough. In the illustrated embodiment, the axial extent or length of tubular or cylindrical fasteners 160 and 162 is such that their leading end portions extend somewhat into these opposite through apertures 176 and 178, thus assuring initial engagement thereof with the externally threaded fastener members 150 and 152.

In this latter regard, further assembly is effected by aligning outer mounting plate 76 with openings 84, 176 and 178 in the outer surface 12 of the door 10 and inserting the fasteners 150 and 152 therethrough and fully advancing these fasteners with respect to the complementary post members 160 and 162. Thereupon, a preassembled arrangement comprised of the knob 56, extension 60 and shaft 64 is provided. This assembly is further assembled within the outer bearing sleeve 72 in the same fashion previously mentioned, that is, by use of the snap ring 136. The resulting assembly of component parts is then inserted through the complementary aperture 98 of escutcheon plate 42 with the end of shaft 64 engaged with cam member 68. The escutcheon plate 42 is next utilized in wrench-like fashion as previously mentioned to rotate the sleeve 72 with respect to extension 60, thereby to effect threadable engagement of the threaded leading end 90 of said sleeve member 72 with the complementary internal threads 92 of the mounting plate 76.

Upon full advancement between these threads 90, 92, the escutcheon plate 42 is rotated so as to be positioned with its through aperture 44 in alignment with the aperture 24 in the surface 12 of the door 10. The lock cylinder assembly 20 and security ring 38 are next assembled through escutcheon plate 42 with the cylinder 20 being engaged with the threaded aperture 22 of the lock assembly in the manner previously described. Upon full engagement of the cylinder lock member 20 with respect to complementary threaded aperture 22, set screw 28 is positioned to engage slot 26. It will be remembered that set screw 28 fixes the lock cylinder in place and prevents the rotation required for removal of lock cylinder 20, thus preventing disassembly of the knob and escutcheon assembly of the invention.

The lock cylinder 20 and set screw 28 in effect provide holding means for the escutcheon plate 42 in that when in place lock cylinder 20 prevents rotation of and/or removal of the esctucheon 42. It is contemplated that an alternate form of holding means can be employed for escutcheon, as for example, any one of a number of tamper-proof type fasteners available on the market. Also, a pin member could be engaged through the escutcheon plate and fixed in position by components operable from the edge 16 of the cell door 10.

In this latter regard, it will be recognized that disassembly requires the foregoing steps in substantially the opposite order as just described. Initially, this requires access to the edge portion 16 of the door 10 for removal or disengagement of set screw 28 with respect to cylinder 20. It is contemplated that the door 10 and lock mechanism 18 are normally in a closed and locked position, whereby such access to edge 16 is prevented. Further, since the lock cylinder 20 and escutcheon plate 42 are operatively engaged, the plate 42 cannot be rotated until the lock cylinder 20 is removed. Thus, since rotation of the escutcheon plate 42 is required to remove the bearing sleeve 72, and said plate 42 overlies and controls access to fasteners 150 and 152, disassembly of the knobs and latch assembly 18 is precluded, until such time as the cylinder 20 is removed. Thus with the structure as illustrated and described, and assuming the cell door 10 in the closed and locked position, it is difficult, if not impossible, for an inmate to tamper with or vandalize the knob and lock assembly 18 from either the inner or outer sides of the cell door 10. In this regard, it should be noted that for the safety of an inmate it is often just as essential to lock other inmates out of a cell, as it is to keep an inmate within the cell. Hence, the structure of the invention advantageously prohibits tampering with, unauthorized operation of, or partial disassembly of the knobs, the lock mechanism 18, the escutcheon plate and mounting assembly from either the inner or outer sides of the door 10.

While the invention has been illustrated and described herein with reference to a specific preferred embodiment, the invention is not limited thereto. Those skilled in the art may devise various changes, alternatives and modifications upon reading the foregoing description. It is intended that the invention include such changes, alternatives and modifications insofar as they fall within the spirit and scope of the appended claims.

The invention is claimed as follows:

1. A security door knob assembly for a door having an inner side and an outer side, and latch means, said assembly comprising: inner knob means and outer knob means; mounting means for mounting said inner and outer knob means to the respective inner and outer sides of said door so as to operate at least one associated latch means; said knob means being coupled to predetermined portions of said mounting means so as to be non-removable from the door except as a unit with said portions of said mounting means to which they are coupled; and securing means co-acting with said mounting means for preventing both disassembly and removal of either of said knob means or of said mounting means from said door, from either of the inner or outer sides thereof; said mounting means including an outer mounting plate non-rotatably mounted to a surface of the door and held thereagainst by fastener means, an outer bearing means rotatably coupled with said outer knob means and threadably engaged with said outer mounting plate and at least one non-round outer surface portion on said bearing means said non-round outer surface portion on said bearing sleeve means including a generally cylindrical surface having at least one generally flat surface portion formed therein; escutcheon means overlying both said outer mounting plate and the fastener means and including an aperture through which said bearing means is received, said escutcheon aperture being of a complementary non-round configuration said through aperture defining an internal generally cylindrical surface portion having at least one generally flat surface portion formed therein and alignable with the generally flat surface portion of said bearing sleeve to effect non-rotatable engagement between said escutcheon means and said bearing sleeve means, such that said escutcheon, when fixed prevents rotation of said outer bearing means, with disengagement of said holding means freeing said escutcheon for rotation, such that said escutcheon may be used in a wrench-like manner to rotate said bearing means as required to disassemble or assemble said knob assembly; said holding means comprising a lock having a shoulder overlying said escutcheon means to prevent removal thereof and extending therethrough and into said door so as to be removable only from an edge surface of said door when said door is open.

2. A security door knob assembly for a door having an inner side and an outer side, and latch means, said assembly comprising: inner knob means and outer knob means, mounting means for mounting said inner and outer knob means to the respective inner and outer sides of said door so as to operate said latch means; and securing means co-acting with said mounting means for preventing both disassembly and removal of either of said knob means or said mounting means from said door, from either of the inner or outer sides thereof; wherein said mounting means comprises, a mounting plate secured to one of the sides of said door and bearing sleeve means threadably secured to said mounting plate and rotatably receiving one of said inner and outer knob means therethrough; and wherein said securing means includes at least one non-round outer surface portion on said bearing sleeve means, said non-round outer surface portion on said bearing sleeve means including a generally cylindrical surface having at least one generally flat surface portion formed therein, escutcheon means having a through aperture defining an internal surface of complementary configuration for engaging said bearing sleeve means surface, said through aperture defining an internal generally cylindrical surface portion having at least one generally flat surface portion formed therein and alignable with the generally flat surface portion of said bearing sleeve to effect non-rotatable engagement between said escutcheon means and said bearing sleeve means, such that said escutcheon means may be employed in a wrench-like manner to rotate said bearing sleeve means to effect engagement or disengagement of said bearing sleeve means with said mounting plate means, and holding means for releasably, non-rotatably securing said escutcheon means to said one side of said door.

3. A security door knob assembly according to claim 2, said outer knob means further including an outer knob extension rotatably received through said bearing sleeve means; and said securing means further including snap ring means engagable with said outer knob extension for holding said outer knob extension non-removably and rotatably engaged within said outer bearing sleeve.

4. A security door knob assembly according to claim 2 wherein said mounting means comprises an inner bearing sleeve rotatably receiving said inner knob means, and inner plate means for receiving said inner bearing sleeve; said securing means further including cooperating coupling means on said inner plate means and on said inner bearing sleeve for coupling said inner bearing sleeve with said inner plate means.

5. A security door knob assembly according to claim 4 wherein said cooperating means comprises undercut means on an inner side of said inner plate means with respect to said door and complementary flared-out means on said inner bearing sleeve for engaging said undercut means.

6. A security door knob assembly according to claim 4, said mounting means further including an inner knob extension rotatably received through said inner bearing sleeve; and said securing means further including snap ring means engageable with said inner knob extension for normally holding said inner knob extension non-removably and rotatably engaged within said inner bearing sleeve.

7. A security door knob assembly according to claim 2 wherein said securing means further includes recess means formed in said escutcheon means and overlying said mounting plate thereby preventing removal thereof and of the associated knob means from the door.

8. A security door knob assembly according to claim 2 wherein said mounting plate, said bearing sleeve means and said escutcheon means are associated with said outer knob means and mounted to the outer side of said door, and wherein said mounting means further comprises inner bearing means rotatably coupled with said inner knob means and inner plate means for non-removably receiving said inner bearing means, and wherein said securing means further includes fastening means for removably coupling said inner plate means to said mounting plates through said door, said fastening means being inaccessible from the inner side of said door.

9. A security door knob assembly according to claim 8 wherein said fastening means comprises externally threaded fastener means received through said mounting plate and having driver head means engaged with an outer side of said mounting plate, said recess means of said escutcheon means overlying said driver head means, and complementary internally threaded means non-removably coupled to said inner plate means to thereby draw said inner plate means and said mounting plate against respective inner and outer sides of said door.

10. A security door knob assembly according to claim 2 wherein said holding means comprises lock means mounted through said escutcheon means to a lock assembly inside of said door, said lock means including shoulder means overlying said escutcheon means so as to prevent removal thereof relative to said door.

* * * * *